US010364990B2

(12) United States Patent
Lee

(10) Patent No.: US 10,364,990 B2
(45) Date of Patent: Jul. 30, 2019

(54) COOKING APPLIANCE

(71) Applicant: LG ELECTRONICS INC., Seoul (KR)

(72) Inventor: Sangkyun Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 478 days.

(21) Appl. No.: 14/995,304

(22) Filed: Jan. 14, 2016

(65) Prior Publication Data

US 2016/0327276 A1 Nov. 10, 2016

(30) Foreign Application Priority Data

May 8, 2015 (KR) ..... 10-2015-0064914

(51) Int. Cl.
*F24C 1/04* (2006.01)
*F24C 7/06* (2006.01)
*F24C 15/18* (2006.01)

(52) U.S. Cl.
CPC ..... *F24C 7/067* (2013.01); *F24C 15/18* (2013.01)

(58) Field of Classification Search
CPC .. F24C 7/065; F24C 7/043; F24C 7/00; F24C 15/34; F24C 7/06; H05B 3/50; A61C 13/20; A47J 37/044; A47J 37/045
USPC ..... 126/19 R; 219/399, 402, 403, 408, 409, 219/520, 532, 536, 537, 400
See application file for complete search history.

(56) References Cited

U.S. PATENT DOCUMENTS 2,894,107 A * 7/1959 Lefebvre ..... H05B 3/00 174/17.05
3,674,982 A * 7/1972 Hoyt ..... A47J 39/006 219/400
3,875,371 A * 4/1975 Skinner ..... F24C 7/06 219/403
3,899,655 A * 8/1975 Skinner ..... F24C 7/06 219/403
4,192,991 A * 3/1980 Peters ..... F24C 3/008 219/386
4,358,669 A * 11/1982 Bryson, Jr. ..... H05B 6/6482 174/174
4,629,865 A * 12/1986 Freedman ..... F24C 15/22 219/392

(Continued)

FOREIGN PATENT DOCUMENTS

DE 2038950 4/1971
DE 3047112 7/1982

(Continued)

OTHER PUBLICATIONS

Korean Notice of Allowance in Korean Application No. 10-2015-0064914, dated May 29, 2017, 1 pages (English translation).

(Continued)

*Primary Examiner* — Jimmy Chou
(74) *Attorney, Agent, or Firm* — Fish & Richardson P.C.

(57) ABSTRACT

A cooking appliance includes a cabinet defining an external surface of the cooking appliance, a cavity that is provided in the cabinet and that defines a cooking space, a heater module provided at an upper part of the cabinet, the heater module including an encapsulation part that is configured to pass through the cavity, and a module bracket configured to fix the heater module to the cavity.

20 Claims, 7 Drawing Sheets

(56) References Cited

U.S. PATENT DOCUMENTS 4,771,154 A * 9/1988 Bell ..... F24C 7/06 219/399
5,132,519 A * 7/1992 Jackson ..... F26B 3/283 219/388
5,272,317 A * 12/1993 Ryu ..... F24C 7/06 219/392
5,961,866 A * 10/1999 Hansen ..... A47J 36/2483 219/403
6,008,478 A * 12/1999 Crone ..... F24C 7/06 219/402
6,097,003 A * 8/2000 Markum ..... F24C 7/06 219/402
6,104,005 A * 8/2000 Adamski ..... F24C 7/06 219/409
6,152,030 A * 11/2000 Fuqua ..... B41F 15/0863 101/115
6,359,262 B1 * 3/2002 Robertson ..... F24C 7/06 219/402
7,489,858 B2 * 2/2009 Zank ..... F24C 7/065 126/19 R
8,413,647 B2 * 4/2013 Nam ..... H05B 3/48 126/19 R
8,952,298 B2 * 2/2015 Fietsam ..... A47J 37/044 219/403
8,971,695 B2 * 3/2015 Tyburk ..... F24H 3/0417 165/123
2005/0230382 A1 * 10/2005 Whipple, Jr. ..... F24C 15/325 219/681
2006/0081593 A1 * 4/2006 Benoit ..... F24C 7/06 219/402
2007/0125766 A1 * 6/2007 Ryu ..... H05B 3/74 219/601
2008/0135539 A1 * 6/2008 Payne Brockman ..... F24C 7/06 219/400
2008/0184983 A1 * 8/2008 Baek ..... F24C 7/067 126/19 R
2010/0012644 A1 * 1/2010 Phillips ..... F24C 15/325 219/400
2011/0259870 A1 * 10/2011 Rogers ..... F24C 7/00 219/394
2012/0325800 A1 * 12/2012 Kutz ..... H05B 3/06 219/481
2013/0019852 A1 * 1/2013 Yu ..... F24C 15/00 126/19 R
2013/0299485 A1 * 11/2013 Lee ..... F24C 7/046 219/399
2013/0334197 A1 * 12/2013 Kim ..... F24C 7/067 219/395
2014/0231407 A1 * 8/2014 Kantas ..... F24C 15/18 219/400
2014/0322417 A1 * 10/2014 Kim ..... F24C 15/322 426/523
2015/0289319 A1 * 10/2015 Boguslavskiy ..... F16M 13/02 219/536

FOREIGN PATENT DOCUMENTS

| | | |
|---|---|---|
| DE | 69201963 | 9/1995 |
| KR | 10-2011-0078910 | 7/2011 |
| KR | 10-2011-0089698 | 8/2011 |
| KR | 10-2011-0089778 | 8/2011 |
| KR | 10-2011-0089779 | 8/2011 |

OTHER PUBLICATIONS

German Office Action in Application No. 102016108299.6, dated Dec. 18, 2017, 15 pages (with English translation).

* cited by examiner

COOKING APPLIANCE

CROSS-REFERENCE TO RELATED APPLICATION(S)

This application claims the benefit of Korean Patent Application No. 10-2015-0064914, filed on May 8, 2015, which is hereby incorporated by reference as if fully set forth herein.

FIELD

The present disclosure relates to a cooking appliance, particularly to a cooking appliance using a charcoal heater as a broil heater.

BACKGROUND

A cooking appliance is an electric home appliance that is used to cook food by heating. A cooking appliance that includes a cavity or chamber for cooking food is generally called an oven.

The cavity is a structural element constituting the frame of the cooking appliance. The cavity may define a space in which food is heated using a heater. The cavity is generally manufactured using a steel sheet. In this case, the cavity is generally coated with enamel for easy cleaning.

A sheathed heater is generally used as a heater for heating food in the cooking space. In addition, a charcoal heater, a halogen heater, a ceramic heater, or a radiation heater may also be used. That is, there are various kinds of heaters that are capable of generating heat using electrical energy, and can be used as the heating source for the cooking appliance. A broil heater is a heater that is used to broil food using direct heat or radiant heat, and a bake heater is a heater that is disposed at the lower part of the cavity to heat the entire cavity. A convection heater is a heater that generates hot air in the cavity and, together with a fan, may improve the uniformity with which food is cooked, and a warming heater is a low-power heater that is used to warm dishes or to keep cooked food warm.

FIG. 1 is a perspective view showing an example of a double oven having two cavities as a conventional cooking appliance, and FIG. 2 is an exploded perspective view of the double oven shown in FIG. 1.

In general, as shown in FIGS. 1 and 2, a cooking appliance 1 includes a cabinet 10 defining the external appearance of the cooking appliance 1. Cavities 50 and 55 are provided in the cabinet 10. One cavity may be provided, or a plurality of cavities may be provided.

The cabinet 10 may include a side panel 11 and a rear panel 12. Doors 40 and 45 may be mounted by a hinge to the cabinet 10 or the cavities 50 and 55. Cooking spaces defined in the cavities 50 and 55 may be opened and closed by opening and closing the doors 40 and 45. That is, a user may open or close the doors 40 and 45 while holding handles 41 and 46. The doors 40 and 45 are pull-down doors, which may be pulled downward in a frontward direction in a state in which the handles 41 and 46 are held.

The cooking appliance may further include a cooktop 20 in addition to the cavities 50 and 55. The cooktop 20 may be provided at the upper surface of the cooking appliance 1. The cooktop 20 may define the upper surface of the cooking appliance 1.

The cooking appliance 1 may further include a control panel 30. The user may manipulate the cooking appliance 1 using the control panel 30. The user may also check a state of operation of the cooking appliance 1 through the control panel 30. A control panel cover 31 may be provided at the rear of the control panel 30. Consequently, the rear panel 12 and the control panel cover 31 may define the rear surface of the cooking appliance 1.

SUMMARY

According to one aspect, a cooking appliance may include a cabinet defining an exterior surface of the cooking appliance, a cavity that is provided in the cabinet and that defines a cooking space, a heater module provided at an upper part of the cabinet, the heater module including an encapsulation part that may be configured to pass through the cavity, and a module bracket configured to fix the heater module to the cavity.

Implementations according to this aspect may include one or more of the following features. For example, the heater module may include a housing configured to receive a charcoal heater, and where each of the housing, the cavity, and the module bracket have fastening holes that correspond to one another. The housing may be provided with an insertion rib, and each of the cavity and the module bracket may be provided with corresponding insertion holes that are configured to receive the insertion rib. The housing may include an upper housing located at a module location part of the cavity, and a lower housing located under and coupled to the upper housing, the lower housing may include a plurality of holes that are configured to communicate with an interior of the cavity. The heater module may include a U-shaped heater with a glass tube, and where the upper housing and the lower housing may be coupled to each other such that the upper housing and the lower housing contact each other inside a U-shaped structure of the heater. A heater bracket configured to support the heater in an inner space of the housing, where the upper housing is provided with a bracket support unit, and where the heater bracket may be fixed to the bracket support unit. The heater bracket may include a base, a hanger configured to hang the heater, and a connection part provided between the base and the hanger, the hanger being spaced apart from the base.

The bracket support unit may include a lancing part configured to receive the base, and where the base may be provided with a bead configured to be fitted into the lancing part. The module bracket may include at least two surface contact parts configured to be in surface contact with an outer surface of the cavity. The heater module may include a glass tube, a heater core disposed in the glass tube, the heater core extending to opposite ends of the glass tube, and terminals that may be configured to provide electrical connection and that are provided at opposite ends of the heater core, where an encapsulation part may be provided at each of the opposite ends of the glass tube, each encapsulation part being configured to seal an interior of the glass tube. The module bracket may be provided with one or more heater fixing parts, and where the encapsulation parts may be fixed to the heater fixing parts.

The glass tube may be configured to prevent contact with the cavity and the module bracket, and where the encapsulation parts may be configured to prevent contact with the cavity. Each encapsulation part may be supported at the module bracket by the one or more heater fixing parts. The one or more heater fixing parts may be bent to surround each encapsulation part. Each of the one or more heater fixing parts may be provided with a slot configured to decrease a sectional area of a bent part. The module bracket may be provided with one or more slits, and where the one or more heater fixing parts may be provided with fixing parts configured to be inserted through the slits.

According to another aspect, a cooking appliance may include a charcoal heater module with a charcoal heater, and a housing configured to receive the charcoal heater, the housing including a hole configured to allow a portion of the charcoal heater to extend outside the housing for electrical connection, a cavity defining a cooking space, the cavity including a hole configured to allow a portion of the charcoal heater to extend from an inside of the cavity to an outside of the cavity, and a module bracket that may be coupled to the cavity and the housing outside the cavity and that may be configured to fix the housing to the cavity, where the module bracket may be configured to fix the charcoal heater outside the cavity. Implementations according to this aspect may include one or more of the following features. For example, the charcoal heater module may be disposed at an upper part of the cavity, and the charcoal heater is a broil heater. Each of the housing, the cavity, and the module bracket may be provided with heater passage holes, where each of the heater passage holes has an inner diameter greater than an outer diameter of the charcoal heater, and where the charcoal heater extends through the heater passage holes and may be fixed to the module bracket through charcoal heater fixing parts located at the module bracket. The housing may be provided with an insertion rib, and the cavity and the module bracket may be provided with insertion holes configured to receive the insertion rib.

It is to be understood that both the foregoing general description and the following detailed description of the present invention are exemplary and explanatory and are intended to provide further explanation of the invention as claimed.

DETAILED DESCRIPTION

Figure 1:
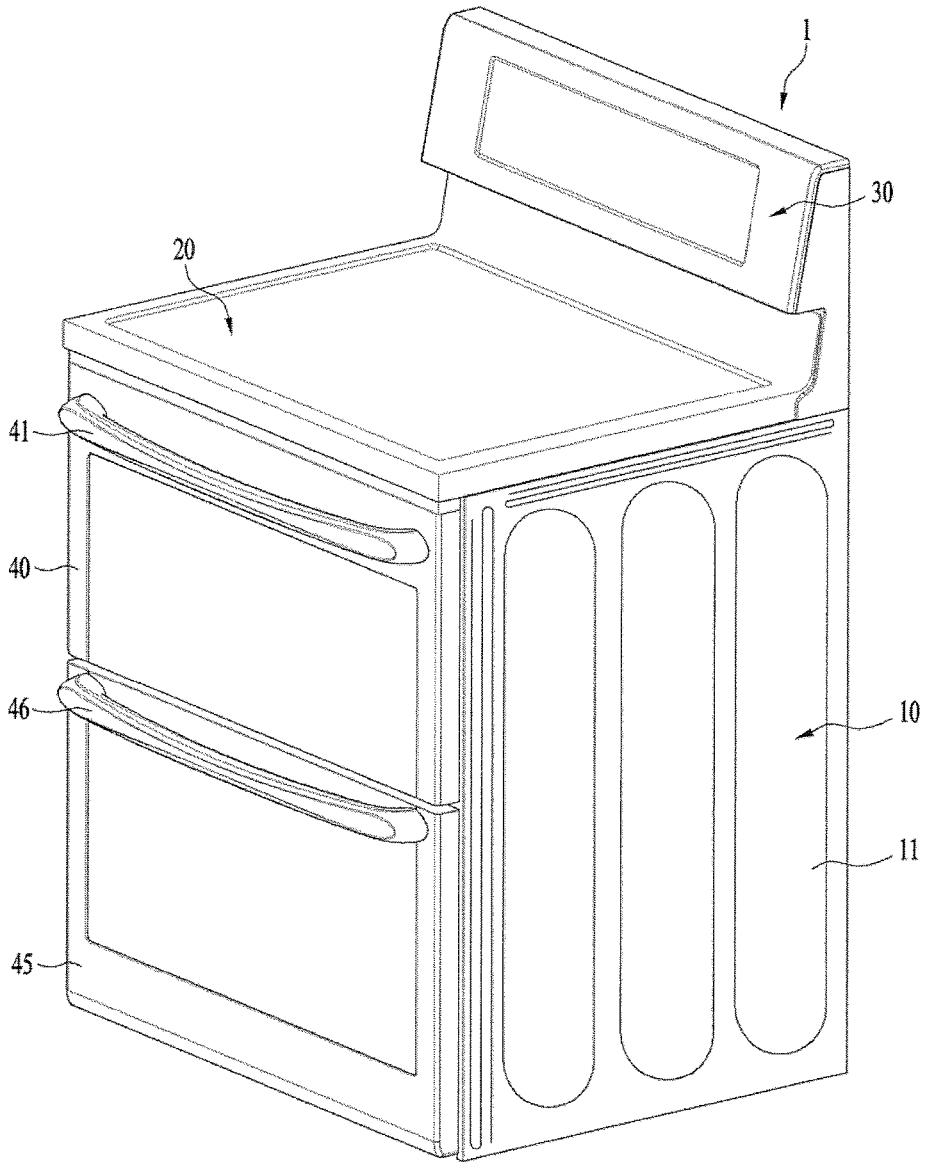
FIG. 1 is a perspective view showing an example of the external appearance of a general cooking appliance, particularly an oven.
Figure 2:
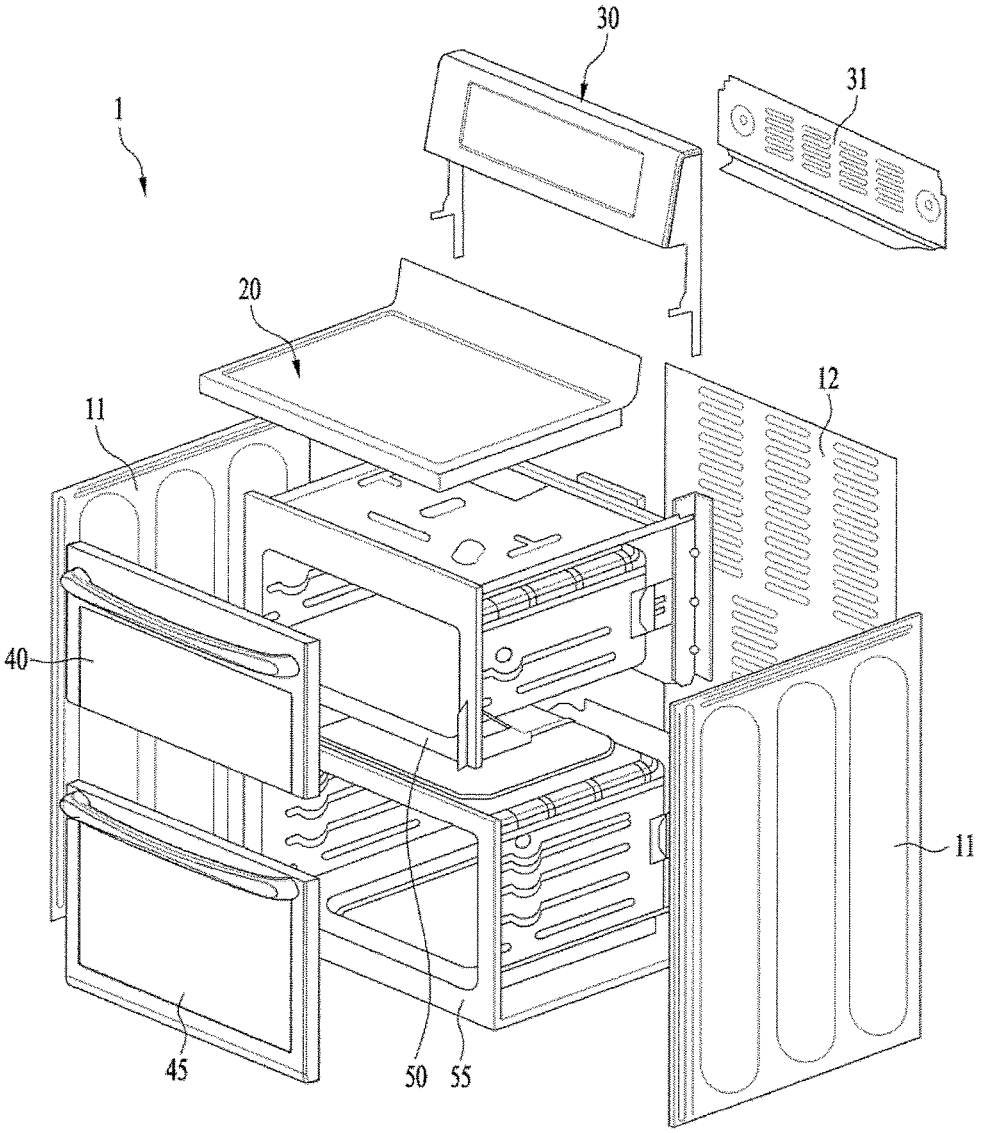
FIG. 2 is an exploded perspective view of the example cooking appliance shown in FIG. 1.
Figure 3:
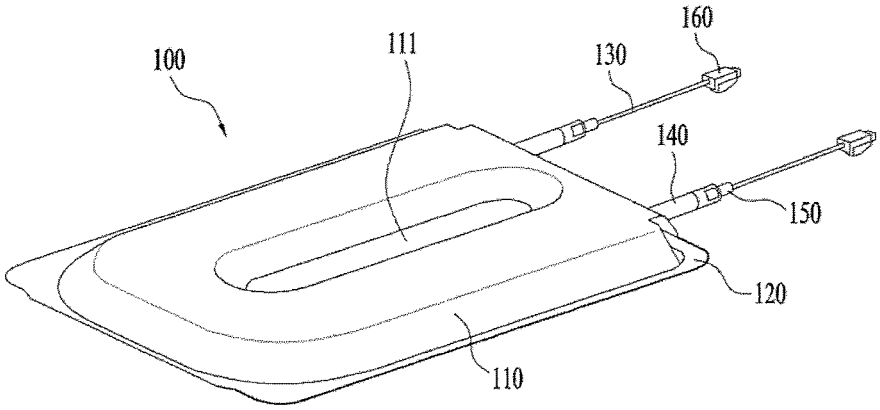
FIG. 3 is a perspective view showing an example charcoal heater module.

As illustrated in FIG. 3, a charcoal heater module 100 may include housings 110 and 120. A charcoal heater 130 may be supported in the housings 110 and 120. A portion of the charcoal heater 130 extends outside the housings 110 and 120 for electrical connection. The housings 110 and 120 may include an upper housing 110 and a lower housing 120. The upper housing 110 and the lower housing 120 may be coupled to each other in order to receive the charcoal heater 130 therein.

The upper housing 110 is disposed to face the upper surface of a cavity, and the lower housing 120 is disposed under the upper housing 110 to face the lower surface of the cavity. The charcoal heater module 100 is disposed in the upper part of the cavity, in a state shown in FIG. 3, to heat and cook food that is placed in the cavity. The charcoal heater module 100 is mounted in the cavity to serve as a broil heater for cooking food placed under the charcoal heater module 100 by heating. The upper housing 110 serves to reflect light and heat such that the reflected light and heat can be effectively supplied to food through the lower housing 120. For this reason, the upper housing 110 may be referred to as a reflector. The lower housing 120 is configured to face the food. The heat and light generated by the charcoal heater 130 are supplied to the food through the lower housing 120. That is, the lower housing 120 is disposed to be very close to the food such that the food is cooked using heat and light.

The lower housing 120 is provided with a plurality of through holes 123. The size of each of the through holes 123 and the number of through holes 123 may be increased in order to effectively supply heat and light to the food. However, the size of each of the through holes 123 and the number of through holes 123 may be appropriately set in order to prevent the hand of a user or a container from being introduced into the charcoal heater module 100 through the through holes 123.

Each of the through holes 123 may be formed in a long hole shape having a relatively large horizontal length. Each of the through holes 123 may be formed in a long hole shape having a larger length in a direction perpendicular to a direction in which food is introduced and removed. As a result, it is possible to effectively prevent a container or a hand of the user from being introduced into the housings 110 and 120.

The charcoal heater 130 may be formed in a U shape. Specifically, the charcoal heater 130 includes a glass tube 140, and a charcoal heater core 131, which is disposed in the glass tube 140, and may generate light and heat. The glass tube 140 may also be formed in a U shape. The charcoal heater core 131, which is disposed in the glass tube 140, may further extend to opposite ends of the glass tube 140. The charcoal heater core 131 is connected to terminals 160 for electrical connection outside the glass tube 140.

Encapsulation parts 150 are formed at the opposite ends of the glass tube 140. The encapsulation parts 150 may be made of a ceramic material. The encapsulation parts 150 encapsulate the opposite ends of the glass tube 140. That is, the interior of the glass tube 140 may be sealed using the encapsulation parts 150.

The encapsulation parts 150 may be very fragile and may be easily damaged by impact or vibration. In some implementations, the encapsulation parts 150 may be easily and safely protected. In addition, the charcoal heater 130 may be safely supported by the encapsulation parts 150.

The encapsulation parts 150 are located outside the housings 110 and 120. The terminals 160 for electrical connection are provided at portions further extending from the encapsulation parts 150. The terminals 160 may be formed at opposite ends of the charcoal heater 130. When electrical power is supplied through the terminals 160, the charcoal heater 130 generates light and heat.

The glass tube 140 exhibits low resistance to vibration and impact due to the material characteristics thereof. As a result, it is very difficult to fix the glass tube 140 in the housings 110 and 120. For this reason, it is necessary to provide a structure that is capable of safely supporting the charcoal heater 130 in the housings 110 and 120 through the glass tube 140. In this implementation, a plurality of heater brackets 180 is provided. The charcoal heater 130 may be fixed in the housings 110 and 120 through the heater brackets 180.

Figure 4:
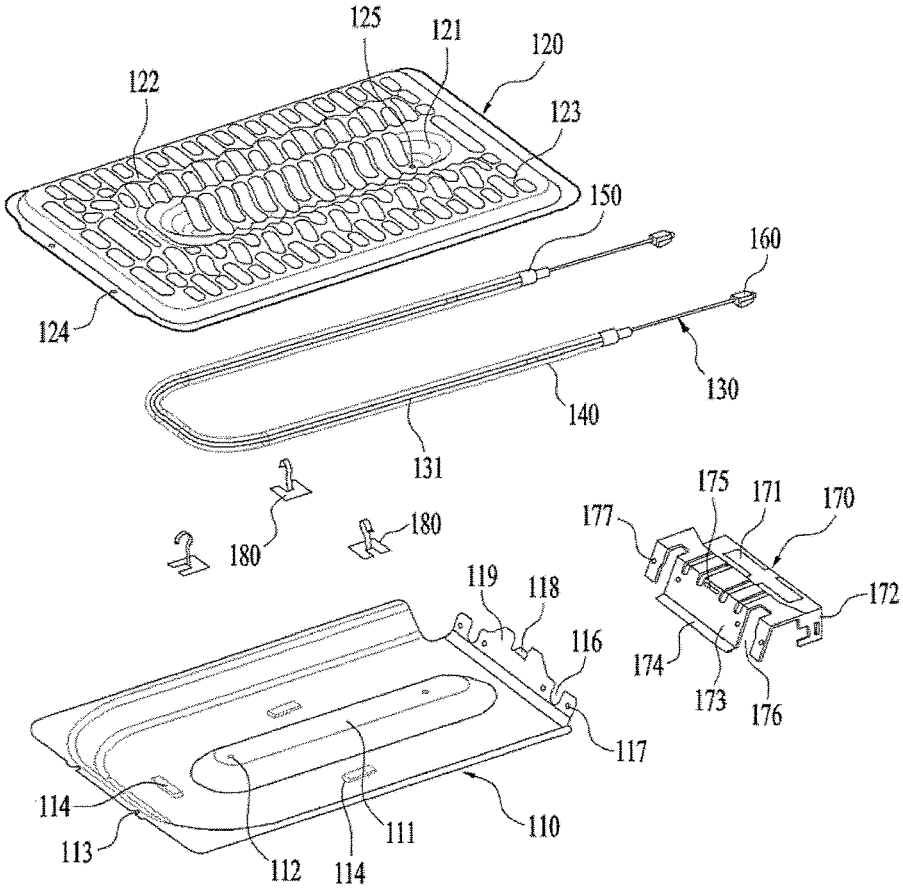
FIG. 4 is an exploded perspective view of the example charcoal heater module shown in FIG. 3.

The upper housing 110 is provided with a plurality of bracket support units 114, to which the heater brackets 180 are fixed. The charcoal heater 130 may be fixed in the housings 110 and 120 through a plurality of support points. For the U-shaped charcoal heater 130, the heater brackets 180 may be connected to a left part, a right part, and a curved part connected between the left part and the right part of the charcoal heater 130. FIG. 4 shows an example in which three heater brackets 180 and three bracket support units 114 are provided.

The heater brackets 180 serve to fix the charcoal heater 130 in a state in which the charcoal heater 130 is suspended in a space defined between the housings 110 and 120. The heater brackets 180 are configured to support the glass tube 140, which surrounds the charcoal heater 130, particularly the charcoal heater core 131, such that the glass tube 140 does not directly contact the housings 110 and 120. When the housings 110 and 120 are vibrated, the glass tube 140, is prevented from colliding with the housings 110 and 120.

As previously described, the charcoal heater 130 and the glass tube 140 may be formed in a U shape. Consequently, the upper housing 110 and the lower housing 120 may be coupled to each other using a region inside the U-shaped structure.

Specifically, as shown in FIGS. 3 and 4, the upper housing 110 is provided with a recess 111, and the lower housing 120 is provided with a protrusion 121. The recess 111 and the protrusion 121 face each other and may be in contact with each other. The recess 111 and the protrusion 121 may have coupling holes 112 and 125, which correspond to each other. The upper housing 110 and the lower housing 120 may be coupled to each other by inserting screws through the coupling holes 112 and 125.

The recess and the protrusion are named on the basis of the charcoal heater module 100 shown in FIG. 3. That is, the recess and the protrusion are named on the basis of a state in which the charcoal heater module 100 is actually mounted in the cavity.

The recess 111 and the protrusion 121 are formed so as not to interfere with the charcoal heater 130. That is, the recess 111 and the protrusion 121 are formed at the region inside the U-shaped structure. Consequently, the charcoal heater 130 is prevented from interfering with the housings 110 and 120. In addition, the upper housing 110 and the lower housing 120 may be coupled to each other at the middle portions as well as at the outer edges thereof. As a result, the upper housing 110 and the lower housing 120 may be more securely coupled to each other.

The lower housing 120 is provided at a portion corresponding to the charcoal heater 130 with a recess 122. The recess 122 is formed such that the distance between the lower housing 120 and the charcoal heater 130 is increased. In other words, the recess 122 is recessed downward. In the same manner, the recess 122 may be formed in a U shape. Consequently, it is possible to prevent the increase in overall height of the charcoal heater module 100. In addition, a sufficient gap may be provided between the charcoal heater 130 and the lower housing 120.

As previously described, the upper housing 110 serves as a reflector. To this end, the recess 111 is located inside the charcoal heater 130. By the provision of the recess 111, it is possible for the upper housing 110 to uniformly supply heat and light to the left and right parts and the front part of the cavity as well as to the portion immediately under the charcoal heater 130. Consequently, heat and light may be uniformly supplied to food placed under the charcoal heater module 100.

Figure 8:
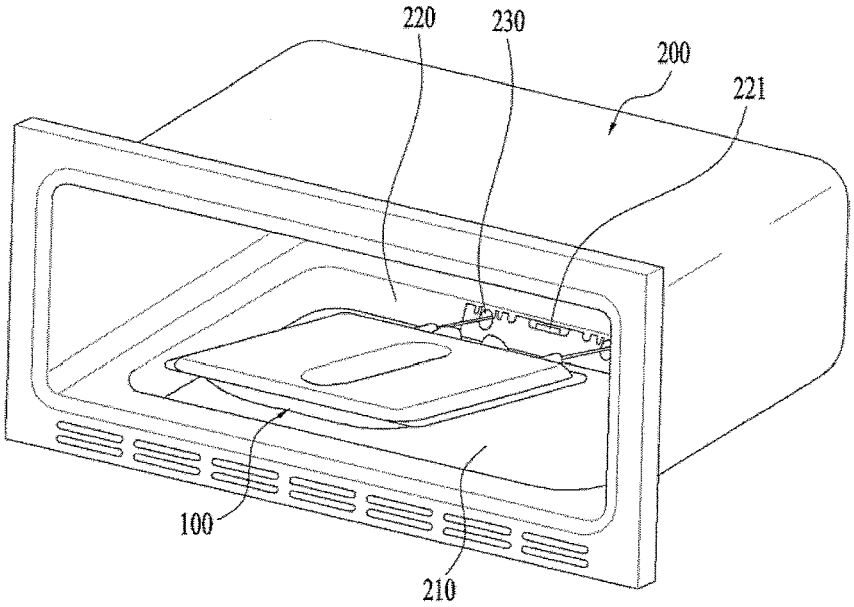
FIG. 8 is a perspective view showing a process in which the charcoal heater module shown in FIG. 3 is temporarily assembled to the cavity.
Figure 9:
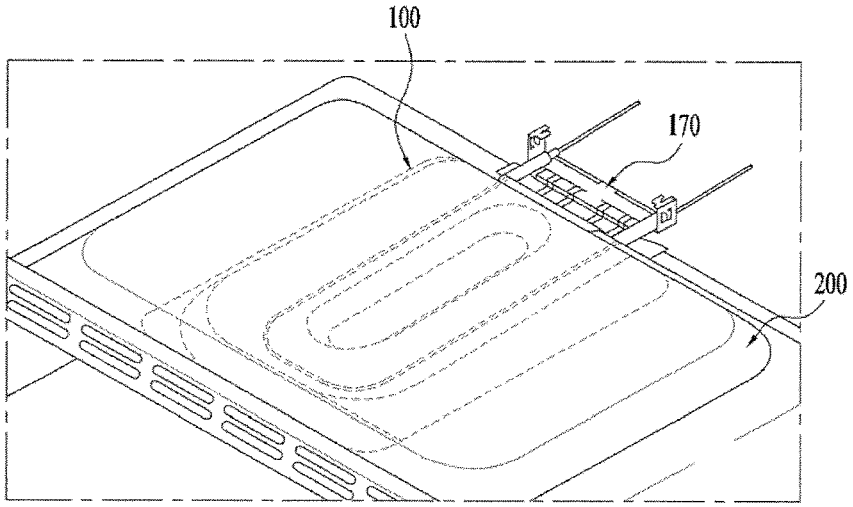
FIG. 9 is a perspective view showing a state in which the charcoal heater module shown in FIG. 3 is temporarily assembled to the cavity.

As shown in FIG. 8, the charcoal heater module 100 is fixed to a cavity 200. The front and rear parts of the charcoal heater module 100 may be fixed to the cavity 200 such that the charcoal heater module 100 is securely fixed to the cavity 200. That is, support points may be formed at the front and rear parts of the charcoal heater module 100. The charcoal heater module 100, particularly the housings 110 and 120, may be formed in a rectangular shape. The forward and backward length of the charcoal heater module 100 may be greater than the leftward and rightward length of the charcoal heater module 100.

The front part of the charcoal heater module 100 may be fixed to the cavity 200 using screws. Coupling slots and coupling holes 113 and 124 may be formed at the front part of the charcoal heater module 100. FIG. 4 shows an example in which the coupling holes 124 are formed at the lower housing 120, and the coupling slots 113 are formed at the upper housing 110. The coupling holes 124 correspond to the coupling slots 113 such that screws can be inserted through the coupling holes 124 and the coupling slots 113. The front part of the charcoal heater module 100 may be fixed to the cavity by inserting the screws through the coupling holes 124 and the coupling slots 113. The cavity may be provided with coupling holes, which correspond to the coupling slots and coupling holes 113 and 124 of the charcoal heater module 100.

As previously described, the upper housing 110 and the lower housing 120 are coupled to each other by inserting screws through the coupling holes 112 and 125. In order to couple the front part of the charcoal heater module 100 to the cavity, therefore, any one of the upper and lower housings may have coupling slots. In some implementations, both the upper and lower housings may have coupling slots.

The passage holes 116, though which the charcoal heater 130, disposed in the housings 110 and 120, extends outside the housings 110 and 120, may be formed at the rear part of the upper housing 110. The size of the passage holes 116 may be greater than those of the charcoal heater 130 and the glass tube 140. That is, the charcoal heater 130 and the glass tube 140 may extend through the passage holes 116 without contacting the passage holes 116. When the housings 110 and 120 are vibrated, interference between the passage holes 116 and the glass tube 140 is prevented.

At the rear part of the charcoal heater module 100 may be provided a module bracket 170 for fixing the charcoal heater module 100 to the cavity. The module bracket 170 is provided to fix the charcoal heater module 100 shown in FIG. 3 to the rear part of the cavity. The module bracket 170 may be included in the charcoal heater module 100, or may be configured separately from the charcoal heater module 100.

The module bracket 170 may fix the charcoal heater module 100 in the cavity in a state in which the module bracket 170 is located outside the cavity. That is, the module bracket 170 may be located outside the cavity. The charcoal heater module 100 may be easily fixed to the cavity.

A module location part 210 is formed in the cavity 200 at the upper side of the cavity 200. Specifically, the module location part 210 may be a part at which the upper housing 110 is located. The module location part 210 may be a portion of the inner upper surface of the cavity 200.

In order to supply electrical power to the charcoal heater 130, the charcoal heater 130 may extend outside the cavity 200. The charcoal heater 130, a portion of the glass tube 140, and the terminals 160 may extend outside the cavity 200. The charcoal heater 130, which is disposed in the cavity 200, may extend outside the cavity 200.

The cavity 200 may be provided with heater passage holes 230. Specifically, the heater passage holes 230 may be formed at the rear part of the cavity 200. The size of the heater passage holes 230 may be greater than that of the glass tube 140. In other words, the sectional area of the heater passage holes 230 may be greater than that of the glass tube 140. As a result, interference between the heater passage holes 230 and the glass tube 140 may be prevented. Gaps between the heater passage holes 230 and the glass tube 140 may be filled with a sealing member. The sealing member may prevent heat or gas in the cavity from being discharged out of the cavity 200. The glass tube 140 may be supported in the cavity 200 while being spaced apart from the cavity 200 in a sealed state by the provision of the sealing member.

In order to more stably fix the charcoal heater module 100 to the cavity 200, a flange 119 may be formed at the rear part of the charcoal heater module 100. Specifically, the flange 119 may be formed at the rear part of the upper housing 110. The flange 119 may be brought into surface contact with the cavity 200. A flange location part 220 may be formed at the rear part of the cavity 200 such that the flange 119 is brought into surface contact with the flange location part 220.

The flange 119 and the flange location part 220 may be formed at an incline. Specifically, the flange 119 and the flange location part 220 may be formed to be inclined downward from the upper part of the cavity 200 in a rearward direction.

Figure 7:
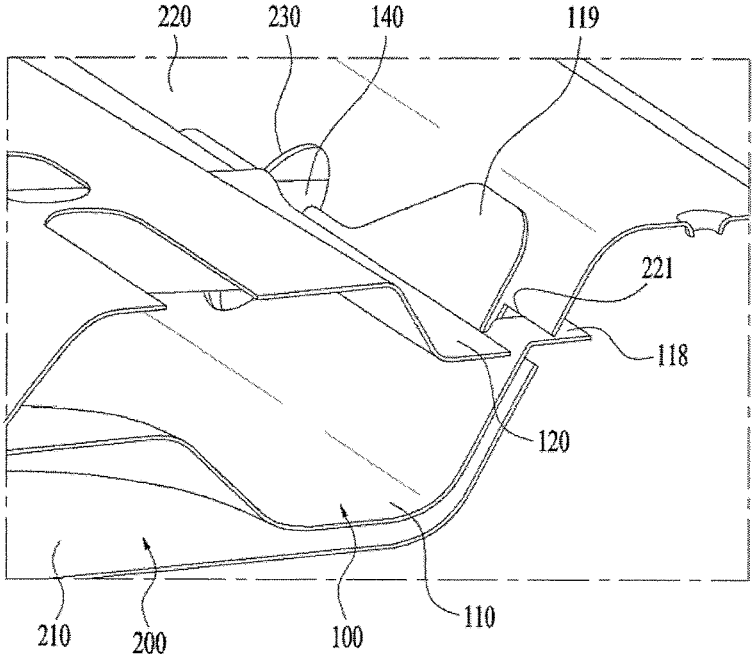
FIG. 7 is a partial sectional perspective view showing a state in which the charcoal heater module shown in FIG. 3 is coupled to a cavity.

FIGS. 7 and 8 show a state in which the cavity 200 is overturned in order to easily fix the charcoal heater module 100 to the cavity 200. The charcoal heater module 100 is fixed to the cavity 200 in a state in which the cavity 200 is upside down.

Specifically, the flange 119 may be provided with an insertion rib 118, and the flange location part 220 may be provided with an insertion hole 221, through which the insertion rib 118 is inserted. In addition, the heater passage holes 230, through which the glass tube 140 extends, may be formed at the flange location part 220.

As shown, the flange 119 and the flange location part 220 are gradually inclined upward in a rearward direction in a state in which the cavity 200 is upside down. In a state as shown, the charcoal heater module 100 may be positioned so as to be inclined downward in the rearward direction, and then the rear part of the charcoal heater module 100 may be temporarily assembled to the cavity 200.

Specifically, after the glass tube 140 and the insertion rib 118 are inserted through the heater passage holes 230 and the insertion hole 221, respectively, the entirety of the charcoal heater module 100 may be positioned horizontally. In other words, the entirety of the charcoal heater module 100 may be primarily temporarily assembled to the flange location part 220 in a state of being perpendicular to the flange location part 220, and then the entirety of the charcoal heater module 100 may be positioned horizontally. That is, the rear part of the charcoal heater module 100 may be temporarily fixed to the flange location part 220.

Subsequently, the front part of the charcoal heater module 100 may be primarily temporarily assembled to the cavity 200 by inserting screws through the coupling holes 124 and the coupling slots 113. That is, the front part of the charcoal heater module 100 is fixed to the cavity 200 by the screws inserted through the coupling holes 124 and the coupling slots 113, and the rear part of the charcoal heater module 100 is temporarily fixed to the cavity 200 by inserting the insertion rib 118 through the insertion hole 221.

As previously described, the glass tube 140 may not contact the heater passage holes 230. The flange 119 is brought into surface contact with the flange location part 220, and the insertion rib 118 is inserted through the insertion hole 221 such that the insertion rib 118 is caught in the insertion hole 221. The front part of the charcoal heater module 100 is fixed to the cavity 200. When the cavity 200 is overturned afterwards, therefore, the charcoal heater module 100 is prevented from being separated downward since the charcoal heater module 100 is temporarily fixed to the cavity 200. As a result, primary coupling between the charcoal heater module 100 and the cavity 200 may be completed.

After the charcoal heater module 100 is temporarily fixed to the cavity 200, the charcoal heater module 100 may be securely fixed to the cavity 200 through the module bracket 170. That is, the charcoal heater module 100 may be finally fixed to the cavity 200 through the module bracket 170.

Figure 10:
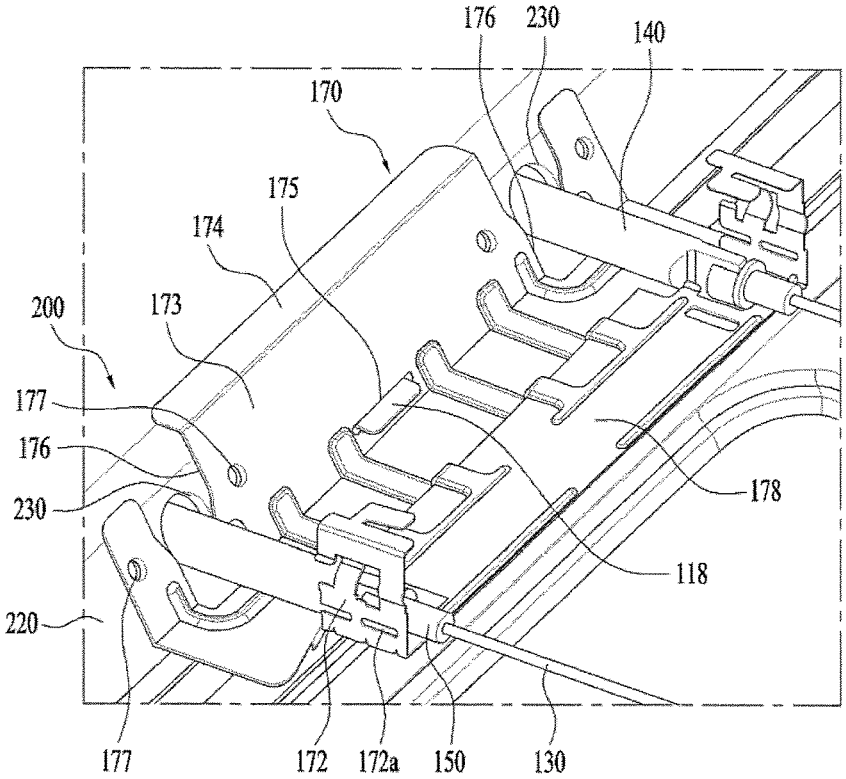
FIG. 10 is a partial perspective view showing a process in which a charcoal heater module is fixed to a module bracket.

The module bracket 170 may be formed to correspond to the external shape of the cavity 200. Specifically, the module bracket 170 may be formed such that a plurality of surface contact parts of the module bracket 170 is brought into surface contact with the outer surface of the cavity 200. FIG. 10 shows an example in which three surface contact parts of the module bracket 170 are brought into surface contact with the outer surface of the cavity 200. The module bracket 170 may be bent such that a plurality of surface contact parts of the module bracket 170 is brought into surface contact with the outer surface of the cavity 200.

First, the module bracket 170 may include a first surface contact part 173 formed to be brought into surface contact with the outer surface of the flange location part 220. The first surface contact part 173 may be provided with through holes 177.

The flange 119 may also be provided with through holes 117, and the flange location part 220 may also be provided with through holes. One screw may be inserted through each of the through holes 177 of the first surface contact part 173, a corresponding one of the through holes 117 of the flange 119, and a corresponding one of the through holes of the flange location part 220.

FIG. 10 shows an example in which screws are inserted through four through holes 177 of the first surface contact part 173. The charcoal heater module 100, the cavity 200, and the module bracket 170 may be coupled to one another at the same time by inserting the screws through the through holes thereof. The charcoal heater module 100, the cavity 200, and the module bracket 170 may be coupled to one another at a plurality of coupling points.

As previously described, the insertion rib 118 of the charcoal heater module 100 is inserted through the insertion hole 221 of the cavity 200. The through holes of the charcoal heater module 100 and the cavity 200 may be aligned through inclined matching between the flange 119 and the flange location part 220.

The module bracket 170 may also be provided with an insertion hole 175, through which the insertion rib 118 is inserted. The insertion rib 118 may be simultaneously inserted through the insertion hole 221 of the cavity 200 and the insertion hole 175 of the module bracket 170. In addition, the module bracket 170 is brought into surface contact with the outer surface of the cavity 200 such that the module bracket 170 is lined up with the outer surface of the cavity 200.

The through holes 177 of the first surface contact part 173, the through holes 117 of the flange 119, and the through holes of the flange location part are aligned simultaneously when the insertion rib 118 is successively inserted through the insertion holes 221 and 175. As a result, it is possible to very easily fix the charcoal heater module 100 to the cavity 200.

The first surface contact part 173 may be provided with charcoal heater passage holes 176 in addition to the through holes 177. The size of the charcoal heater passage holes 176 may be greater than the outer diameter of the glass tube 140 such that the interference between the charcoal heater passage holes 176 and the glass tube 140 is prevented.

The module bracket 170 may be provided with a second surface contact part 174, which is bent from the first surface contact part 173. The second surface contact part 174 may be formed so as to be brought into surface contact with the upper surface of the cavity 200. The first surface contact part 173 and the second surface contact part 174 are brought into surface contact with the upper surface of the cavity 200, whereby the module bracket 170 is more securely fixed to the cavity 200. This means that the charcoal heater module 100 is securely fixed to the cavity 200 by the module bracket 170.

The module bracket 170 may be formed by bending, piercing, and incising a single sheet. The module bracket 170 may be formed as a single body using a metal sheet.

As previously described, the charcoal heater 130 does not interfere with the module housings 110 and 120, excluding the heater brackets 180, the cavity 200, and the module bracket 170. That is, the charcoal heater 130 extends to the rear of the cavity 200 without contacting the module housings 110 and 120, the cavity 200, and the module bracket 170.

In addition, as previously described, the encapsulation parts 150 of the charcoal heater 130 may be easily damaged by vibration or impact. For this reason, it is necessary to protect the encapsulation parts 150 from such vibration or impact.

The module bracket 170 may include charcoal heater fixing parts 172. The charcoal heater fixing parts 172 may be formed to surround the respective encapsulation parts 150. The charcoal heater fixing parts 172 may be formed separately from the module bracket 170. In this implementation, the charcoal heater fixing parts 172 may be integrally formed with the module bracket 170 in order to effectively fix the charcoal heater 130 while reducing the number of parts.

The module bracket 170 may include a flange 178, which is located under the encapsulation parts 150 such that the flange 178 is spaced apart from the encapsulation parts 150 by a predetermined distance. The flange 178 may be formed so as to be brought into at least partial surface contact with the outer surface of the cavity 200. For this reason, the flange 178 may also be referred to as a third surface contact part.

The flange 178 may be formed at the rear of the first surface contact part 173. In addition, the flange 178 may be formed to be parallel to the upper surface of the cavity 200. As a result, interference between the flange 178 and the encapsulation parts 150 may be prevented.

The charcoal heater fixing parts 172, which surround the respective encapsulation parts 150, may be formed at the flange 178 in a state of being bent from the flange 178.

Figure 11:
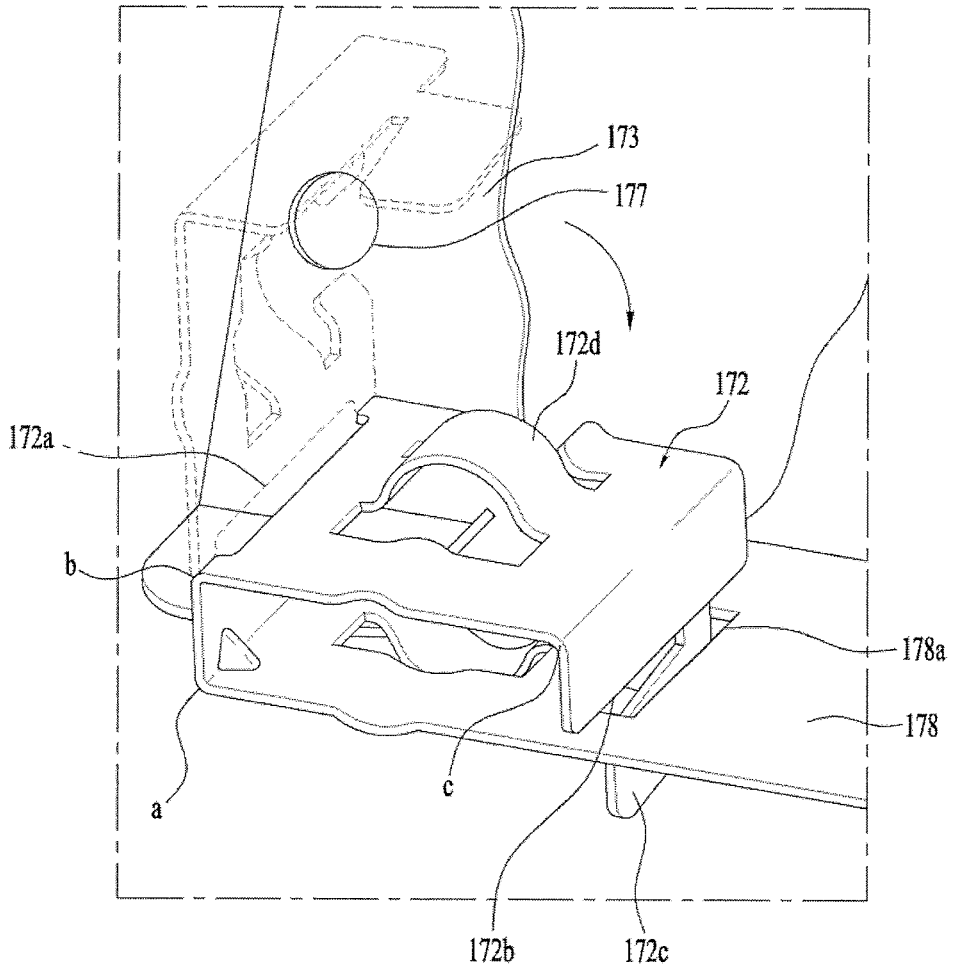
FIG. 11 is a partial perspective view showing a state before the charcoal heater module is fixed to the module bracket and a state after the charcoal heater module is fixed to the module bracket.

As shown in FIG. 11, each charcoal heater fixing part 172 or each encapsulation part support part may include a first bent part a, which is bent upward perpendicularly from the flange 178, a second bent part b, which is bent from the first bent part a such that the second bent part b is parallel to the flange 178, and a third bent part c, which is bent downward perpendicularly from the second bent part b.

Each charcoal heater fixing part 172 may surround a corresponding one of the encapsulation parts 150 such that a corresponding one of the encapsulation parts 150 is located in a space defined by the first bent part a, the second bent part b, and the third bent part c. That is, as shown in FIG. 11, each charcoal heater fixing part 172 may surround a corresponding one of the encapsulation parts 150 in a rectangular shape. Some of the bent parts may be bent in advance. That is, as indicated by a dotted line in FIG. 11, the first bent part a and the third bent part c may be bent in advance. The second bent part b may be bent by a worker when a corresponding one of the encapsulation parts 150 is finally supported. In order to easily bend the second bent part b, a slot 172*a* may be formed at the second bent part b. The second bent part b may be easily bent by the provision of the slot 172*a*. That is, the worker may push each charcoal heater fixing part 172 using his/her finger without using an additional tool to bend the second bent part b.

After each charcoal heater fixing part 172 is bent to surround a corresponding one of the encapsulation parts 150, each charcoal heater fixing part 172 may be continuously maintained in a bent state. That is, each charcoal heater fixing part 172 may continue to surround a corresponding one of the encapsulation parts 150. A hook 172*c* may be formed at each charcoal heater fixing part 172. Correspondingly, a hook hole 178*a* may be formed at the flange 178. As indicated by a solid line in FIG. 11, the hook 172*c* is inserted through the hook hole 178*a* after each charcoal heater fixing part 172 surrounds a corresponding one of the encapsulation parts 150. When the hook 172*c* is twisted by 90 degrees counterclockwise in this state, the hook 172*c* is prevented from coming out of the hook hole 178*a*. Each charcoal heater fixing part 172 continues to surround a corresponding one of the encapsulation parts 150. A slot 172*b* may be formed in order to easily twist the hook 172*c*.

The encapsulation parts 150 may be fixed to the module bracket 170 in a state in which the encapsulation parts 150 are surrounded by the respective charcoal heater fixing parts 172. Each charcoal heater fixing part 172 may be provided with curved parts 172*d*, each of which has a shape corresponding to the external shape of a corresponding one of the encapsulation parts 150. The curved parts 172*d* may be formed at the upper and lower portions of each charcoal heater fixing part 172. As a result, it is possible to more safely and easily support and protect the encapsulation parts 150. The curved part formed at the lower portion of each charcoal heater fixing part 172 may be referred to as a heater location part or an encapsulation part location part.

Figure 5:
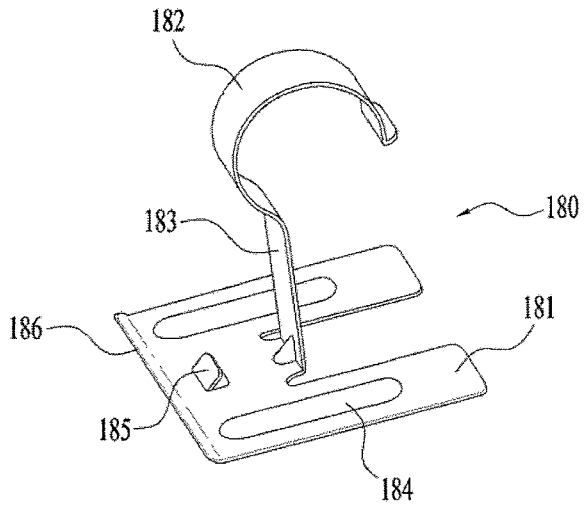
FIG. 5 is a perspective view of an example heater bracket.
Figure 6:
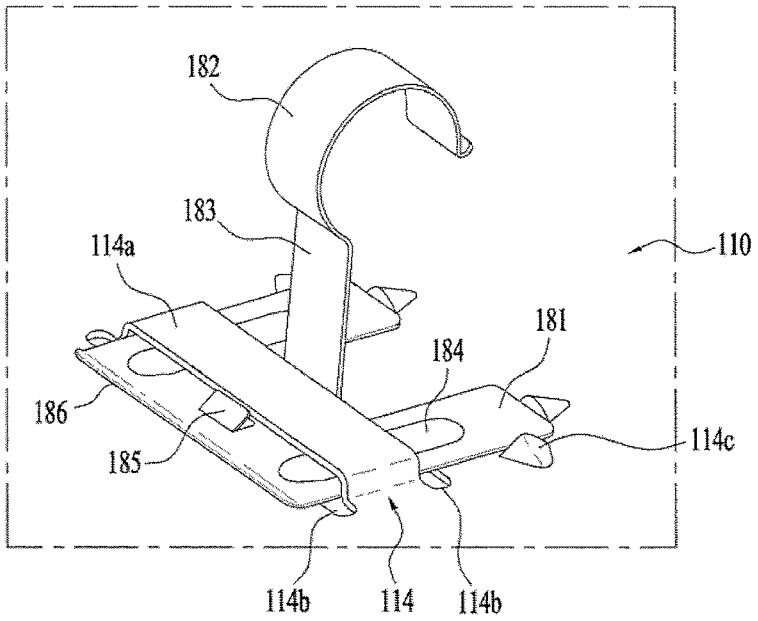
FIG. 6 is a perspective view showing a state in which the heater bracket shown in FIG. 5 is fixed to a bracket support unit.

Hereinafter, a heater bracket 180 and a bracket support unit 114, to which the heater bracket 180 is fixed, will be described in detail with reference to FIGS. 5 and 6. The heater bracket 180 may be mounted to the bracket support unit 114 in a state in which the heater bracket 180 and the bracket support unit 114 are upside down relative to a state shown in FIGS. 5 and 6. Therefore, the following description will be given based on a state in which the heater bracket 180 is actually mounted to the bracket support unit 114. However, the following description may also be given based on a state opposite to the state that is shown.

The heater bracket 180 includes a base 181, which is fixed to the bracket support unit 114. The bracket support unit 114 may be formed at the upper housing 110. The heater bracket 180 may include an extension 183 extending downward and substantially perpendicularly from the base 181. The extension 183 may be provided with a hanger 182. The hanger 182 may be formed in an arc shape. The glass tube 140 may be inserted into the hanger 182. The heater bracket 180 may be formed by bending a single sheet. The hanger 182 and the extension 183 may be elastically deformed.

The extension 183 and the hanger 182 may be formed by incising and bending a portion of the central part of the base 181. Specifically, the base 181 may be fixed to the bracket support unit 114, whereby the entirety of the heater bracket 180 may be fixed to the upper housing 110. The bracket support unit 114 may include a lancing part 114*a*. Slots 114*b* may be formed in front of and behind the lancing part 114*a*. The lancing part 114*a* protrudes downward by a predetermined height. A predetermined vertical gap defined by the lancing part 114*a* may be provided at the bracket support unit 114.

The base 181 may be inserted through the lancing part 114*a*. The base 181 is provided with beads 184, which correspond to the vertical gap defined by the lancing part 114*a*. The base 181 may be forcibly fitted into the lancing part 114*a* by the provision of the beads 184.

Two slots 114*b* are formed in front of and behind the lancing part 114*a* in a state in which the slots 114*b* are parallel to each other. The lancing part 114*a* is formed between the slots 114*b* in a state in which the lancing part 114*a* is recessed by the predetermined vertical gap. The base 181 is inserted through the lancing part 114*a* from one of the slots 114*b* to the other slot. A bent part 186 is formed at the front part of the base 181. The bent part may be gradually inclined upward toward the front end of the base 181 (in a direction in which the base 181 is inserted). The base 181 may be inserted through the lancing part 114*a* in a state in which the base 181 is inclined such that the rear part of the base 181 is higher than the front part of the base 181. When the base 181 is caught in the front slot 114*b*, the bent part 186 may easily slide through the front slot 114*b* such that the bent part 186 passes through the lancing part 114*a*. In this state, the insertion of the base 181 may be stopped.

In order to prevent the base 181 from moving in a rearward direction or in a lateral direction after the insertion of the base 181 through the lancing part 114*a* is completed, a slit structure 114*c* may be provided. The slit structure 114*c* may be formed so as to be recessed downward by bending a portion of the upper housing 110. The slit structure 114*c* may be brought into contact with the outer edge of the base 1181 such that the base 181 is securely fixed to the upper housing 110.

The base 181 may be provided with a hook 185. The hook 185 may be formed to be inclined in a direction opposite to the direction in which the base 181 is inserted. The hook 185 may be formed to be inclined toward the rear part of the base 181. When the base 181 is inserted through the lancing part 114*a*, therefore, interference between the base 181 and the lancing part 114*a* may be minimized. The base 181 may be more easily inserted through the lancing part 114*a* due to elastic deformation of the hook 185.

When the insertion of the base 181 through the lancing part 114*a* is completed, the hook 185 is caught by the front side of the lancing part 114*a*. As a result, the base 181 is prevented from being separated from the lancing part 114*a*.

In order to separate the heater bracket 180 from the upper housing 110, the rear part of the heater bracket 180 may be raised, and may then be pulled in the rearward direction. As a result, a state in which the hook 185 is caught by the lancing part 114*a* may be released. Since the base 181 may be made of a metal sheet, which is easily deformable, the base 181 may be easily separated from the lancing part 114*a*. The base 181 may be easily separated from the lancing part 114*a* through the front slit 114*b* by the provision of the bent part 186.

The bracket support unit 114 may be integrally formed with the upper housing 110 through sheet metal working. The bracket 180 may be easily fixed to the upper housing 110 without using fixing devices, such as screws. In addition, after the bracket 180 is fixed to the bracket support unit 114, a state in which the bracket 180 is fixed to the bracket support unit 114 may be securely maintained without using additional fixing devices.

It will be apparent to those skilled in the art that various modifications and variations can be made without departing from the spirit or scope of the disclosure. Thus, it is intended that the present disclosure covers modifications and variations that come within the scope of the appended claims and their equivalents.

What is claimed is:

1. A cooking appliance comprising:

a cabinet defining an exterior surface of the cooking appliance;

a cavity frame that is provided in the cabinet and that defines a cooking space, wherein a portion of an inner surface of the cavity frame is a module location part;

a heater module that includes a heater having an encapsulation part and that includes a housing configured to receive the heater, the housing being provided inside the cavity frame at an upper part of the cabinet; and a module bracket configured to fix the heater module to an outside of the cavity frame, wherein the housing defines a through hole configured to allow the encapsulation part to extend from inside the housing to outside the housing, wherein the cavity frame defines a through hole configured to allow the encapsulation part to extend from inside the cavity frame to outside the cavity frame, and wherein the housing is located at the module location part of the cavity frame.

2. The cooking appliance according to claim 1, wherein the housing, the cavity frame, and the module bracket each have fastening holes that correspond to one another.

3. The cooking appliance according to claim 2, wherein the housing is provided with an insertion rib, and each of the cavity frame and the module bracket are provided with corresponding insertion holes that are configured to receive the insertion rib.

4. The cooking appliance according to claim 3, wherein the housing comprises:

an upper housing located at the module location part of the cavity frame; and a lower housing, located under and coupled to the upper housing, the lower housing including a plurality of holes that are configured to communicate with an interior of the cavity frame.

5. The cooking appliance according to claim 4, wherein the heater module comprises a U-shaped glass tube, and wherein the upper housing and the lower housing contact each other and form a U-shaped structure of the glass tube.

6. The cooking appliance according to claim 4, further comprising a heater bracket configured to support the heater in an inner space of the housing, wherein the upper housing is provided with a bracket support unit, and wherein the heater bracket is fixed to the bracket support unit.

7. The cooking appliance according to claim 6, wherein the heater bracket comprises:

a base;

a hanger configured to hang the heater; and a connection part provided between the base and the hanger, the hanger being spaced apart from the base.

8. The cooking appliance according to claim 7, wherein the bracket support unit comprises a lancing part configured to receive the base, and wherein the base is provided with a bead configured to be fitted into the lancing part.

9. The cooking appliance according to claim 4, wherein the module bracket comprises at least two surface contact parts configured to be in surface contact with an outer surface of the cavity frame.

10. The cooking appliance according to claim 1, wherein the heater module comprises:

a glass tube;

a heater core disposed in the glass tube, the heater core extending to opposite ends of the glass tube; and terminals that are configured to provide electrical connection and that are provided at opposite ends of the heater core, wherein an encapsulation part is provided at each of the opposite ends of the glass tube, each encapsulation part being configured to seal an interior of the glass tube.

11. The cooking appliance according to claim 10, wherein the module bracket is provided with one or more heater fixing parts, and wherein the encapsulation parts are fixed to the heater fixing parts.

12. The cooking appliance according to claim 11, wherein the glass tube is configured to prevent contact with the cavity frame and the module bracket, and wherein the encapsulation parts are configured to prevent contact with the cavity frame.

13. The cooking appliance according to claim 11, wherein each encapsulation part is supported at the module bracket by the one or more heater fixing parts.

14. The cooking appliance according to claim 11, wherein the one or more heater fixing parts are bent to surround each encapsulation part.

15. The cooking appliance according to claim 14, wherein each of the one or more heater fixing parts is provided with a slot configured to decrease a sectional area of a bent part.

16. The cooking appliance according to claim 14, wherein the module bracket is provided with one or more slits, and wherein the one or more heater fixing parts are provided with fixing parts configured to be inserted through the slits.

17. A cooking appliance comprising:

a charcoal heater module comprising:

a charcoal heater; and a housing configured to receive the charcoal heater, the housing including a hole configured to allow a portion of the charcoal heater to extend outside the housing for electrical connection;

a cavity frame defining a cooking space, the cavity frame including a hole configured to allow a portion of the charcoal heater to extend from an inside of the cavity frame to an outside of the cavity frame; and a module bracket that is coupled to the cavity frame and the housing outside the cavity frame and that is configured to fix the housing to the cavity frame, wherein the module bracket is configured to fix the charcoal heater outside the cavity frame, wherein a portion of the inner surface of the cavity frame is a module location part and the housing is located at the module location part of the cavity frame.

18. The cooking appliance according to claim 17, wherein the charcoal heater module is disposed at an upper part of the cavity frame, and the charcoal heater is a broil heater.

19. The cooking appliance according to claim 17, wherein the housing, the cavity frame, and the module bracket are each provided with heater passage holes, wherein the heater passage holes has an inner diameter greater than an outer diameter of the charcoal heater, and wherein the charcoal heater extends through the heater passage holes and is fixed to the module bracket through charcoal heater fixing parts located at the module bracket.

20. The cooking appliance according to claim 19, wherein the housing is provided with an insertion rib, and the cavity frame and the module bracket are provided with insertion holes configured to receive the insertion rib.

* * * * *